US005149290A

United States Patent [19]

Reveen

[11] Patent Number: 5,149,290

[45] Date of Patent: * Sep. 22, 1992

[54] CONFETTI CANNON

[76] Inventor: Tyrone J. Reveen, 12-B Sunset Way, #208, Henderson, Nev. 89014

[ * ] Notice: The portion of the term of this patent subsequent to May 14, 2008 has been disclaimed.

[21] Appl. No.: 698,598

[22] Filed: May 10, 1991

Related U.S. Application Data

[63] Continuation-in-part of Ser. No. 188,537, Apr. 29, 1988, Pat. No. 5,015,211, which is a continuation-in-part of Ser. No. 940,866, Dec. 12, 1986, abandoned.

[51] Int. Cl.[5] ..... A63H 33/30; A63H 37/00

[52] U.S. Cl. ..... 446/475; 124/74; 222/5

[58] Field of Search ..... 446/475, 176, 211; 124/74, 76, 64, 77; 222/637, 5

[56] References Cited

U.S. PATENT DOCUMENTS

| | | | |
|---|---|---|---|
| 2,345,173 | 3/1944 | Baggott | 446/475 X |
| 2,375,314 | 5/1945 | Mills | 124/74 X |
| 2,725,048 | 11/1955 | Koogle | 124/74 X |
| 2,756,737 | 7/1956 | Resch, Jr. | 446/475 X |
| 3,204,625 | 9/1965 | Shepherd | 124/74 |
| 3,345,977 | 10/1967 | Hall | 124/77 |
| 3,382,859 | 5/1968 | Myers | 124/74 |
| 4,531,503 | 7/1985 | Shepherd | 124/76 |
| 5,015,211 | 5/1991 | Reveen | 124/74 X |

*Primary Examiner*—Mickey Yu

*Attorney, Agent, or Firm*—Quirk, Tratos & Roethel

[57] ABSTRACT

A portable, lightweight confetti cannon for projecting confetti to heights of 30–40 feet in the air is used to create spectacular displays for rock concerts or stage shows. The cannon consists of a hollow barrel having a length of at least 8", preferably at least 16" and a length-/diameter ratio of at least 14 having a $CO_2$ cartridge radially mounted at its base. The cartridge is covered by an insulated grip. A valve is mounted between the cartridge and the barrel and has a cartridge puncturing mechanism which enables complete discharge of $CO_2$ cartridge contents in less than three seconds.

16 Claims, 4 Drawing Sheets

CONFETTI CANNON

RELATIONSHIP TO OTHER CASES

This application is a continuation-in-part of application Ser. No. 07/188,537, filed Apr. 29, 1988, now U.S. Pat. No. 5,015,211, which in turn was a continuation-in-part of application Ser. No. 940,866, filed Dec. 12, 1986, abandoned entitled Confetti Cannon.

BACKGROUND OF THE INVENTION

This invention relates to a device for creating a spectacular visual effect for stage shows, rock concerts, and the like. More particularly, it relates to a light-weight, small, portable device capable of discharging an explosion of confetti to heights of forty feet or above in a sudden burst.

The success of stage spectaculars, such as rock concerts, large stage shows, and other "happenings" is often dependent in part upon the visual effects which are portrayed upon the stage. Performing groups and Las Vegas-type stage shows often spend hundreds of thousands of dollars to create visual extravaganzas in an effort to create an exciting atmosphere for performers. Lighting effects, lasers, water fountains, and spectacular scenery are often used.

The present invention provides a method of discharging large quantities of confetti high into the air in an explosive manner, creating a visually spectacular shower effect. The confetti, glitter, or other loose material may be propelled to a height of up to forty feet or more into the air, from where it descends slowly to create a remarkable effect. The present invention provides a lightweight, portable cannon, which is reusable and is capable of carrying its own self-contained explosion charge to propel the contents into the air. Because of the amount of material to be displayed and the height that it must be lifted, the device takes full advantage of and maximizes the efficiency of the available charge. In general, the device consists of an elongated tubular barrel which contains the objects to be discharged, with a disposable $CO_2$ cartridge mounted in a grip member at one end thereof. The cartridge has a puncturing mechanism which enables a substantially instantaneous discharge of the contents of the cartridge (i.e., in less than about two seconds), thereby providing an explosive discharge to the contents of the tube.

In the past, apparatus for discharging large amounts of lightweight objects into the air for commercial settings have used large tanks of compressed air and have barrels with a relatively low length-to-diameter ratio. These devices are expensive and cumbersome, since they are not easily transported. After use, the entire compressed air tank must be refilled, thus requiring the use of an air compressor. In addition, it is more difficult to hide these bulky pieces of equipment in a scenery set.

Other known prior art devices have been used to propel confetti or coiled paper and have generally been limited to use by individuals at parties, such as birthdays and New Year's Eve celebrations. These devices have been employed to propel either long strips or small pieces of paper into the air, and are small, hand-held, inexpensive, and discarded after a one-time use. Examples of such devices are the explosive charge activated by a hand-pulled string, as in the Kliemant patent, U.S. Pat. No. 825,843, or by means of a lighted fuse as shown in the Craig patent, U.S. Pat. No. 1,664,401. In Eisenberg, U.S. Pat. No. 1,153,207, and Macchia, U.S. Pat. No. 1,441,809, the propelled media is forced into the air by blowing with a person's mouth into an orifice. Rutherford, U.S. Pat. No. 1,560,326 shows a similar product using bellows to discharge the product. Resch, U.S. Pat. No. 2,756,737 contemplates the use of a manually-operated piston or a compressed gas cylinder to propel a cartridge of a coiled streamer from inside a barrel by directing a fluid stream through the center of the cartridge. The Resch patent differs from the device of the invention in that the invention comprises a cannon having a long barrel into which the material is to be discharged is paced as a plug, and is discharged in an explosive manner when the contents of the $CO_2$ cartridge are released.

Accordingly, it is the object of this invention to provide a relatively small, portable, rechargeable cannon for explosively discharging lightweight objects into the air. It is another object of the invention to provide a propelling device whereby confetti can be loaded and packed into a barrel abutting a gas discharge orifice. It is a further object of the invention to provide a device that can instantaneously and suddenly discharge the contents of its gas cylinder charge into the barrel. Yet a further object of the invention is to provide a barrel having dimensions adequate to hold a relatively large amount of medium to be discharged, while providing the proper discharge characteristics to achieve a substantial vertical height upon explosion. These and other objects are accomplished by means of the invention, a preferred embodiment of which is disclosed herein.

BRIEF SUMMARY OF THE INVENTION

A propulsion device for projecting confetti to heights in excess of 30–40' into the air comprises a barrel having a length of at least about 18", preferably at least about 3', and a length/diameter ratio of at least about 14 and preferably at least about 20. Propulsion means comprising a small disposable $CO_2$ cartridge is mounted at a lower end of the barrel; in a preferred embodiment, the cartridge is mounted radially to the barrel, and is contained inside an insulative sleeve which also serves as a grip. A trigger which also includes a cartridge puncturing pin fabricated to substantially instantaneously release the cartridge content is mounted at a lower end of the barrel.

DETAILED DESCRIPTION OF A PREFERRED EMBODIMENT

The confetti cannon of the invention is a device that discharges confetti high into the air by utilizing compressed $CO_2$ contained in a small cylinder as the propulsion medium.

Figure 1:
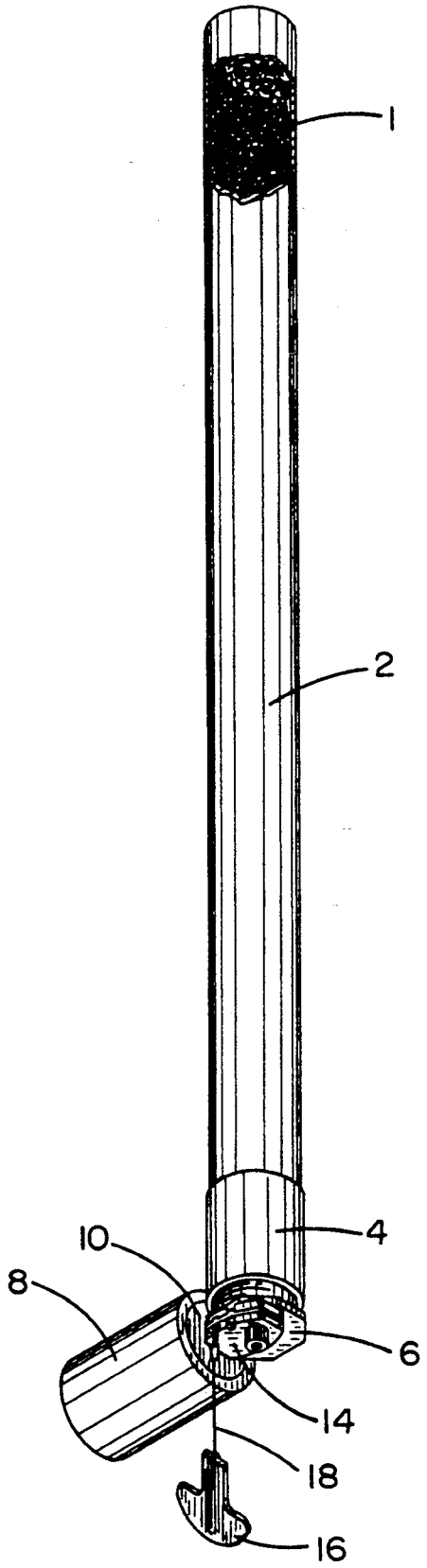
FIG. 1 is a perspective view of the confetti cannon of the invention.

The configuration of the cannon is shown in FIG. 1. It consists generally of a hollow cylindrical barrel 2, packed with confetti 1, an insulated grip 8 extending radially from the base of the barrel and containing a $CO_2$ cartridge, and a release valve 14 for substantially instantaneous release of the cartridge contents. The term "confetti" as used herein refers to quantities of very small particulate paper or plastic in the form of discrete colored disks. Hundreds of these disks can be packed into a volume of less than a cubic inch, yet will scatter in a shower to provide a pleasing visual effect. Also included within the definition of "confetti" are confetti streamers, which are small discrete coiled streamers which are packed randomly into the cannon. These confetti streamers, which are sometimes referred to as "Kabuki streamers", are tightly coiled paper or foil streamers which may be e.g., 10–15 feet long and about ¼" wide. They are coiled to an exterior coil diameter of about ¾". These dimensions should be considered as examples, as variations are possible. After making sure that one end of the confetti streamers is loose (i.e., not stuck to the coil), the confetti streamers are packed into the cannon in the same manner as confetti (i.e., randomly, without orientation of the coils to the flow of $CO_2$ through the barrel).

Figure 2:
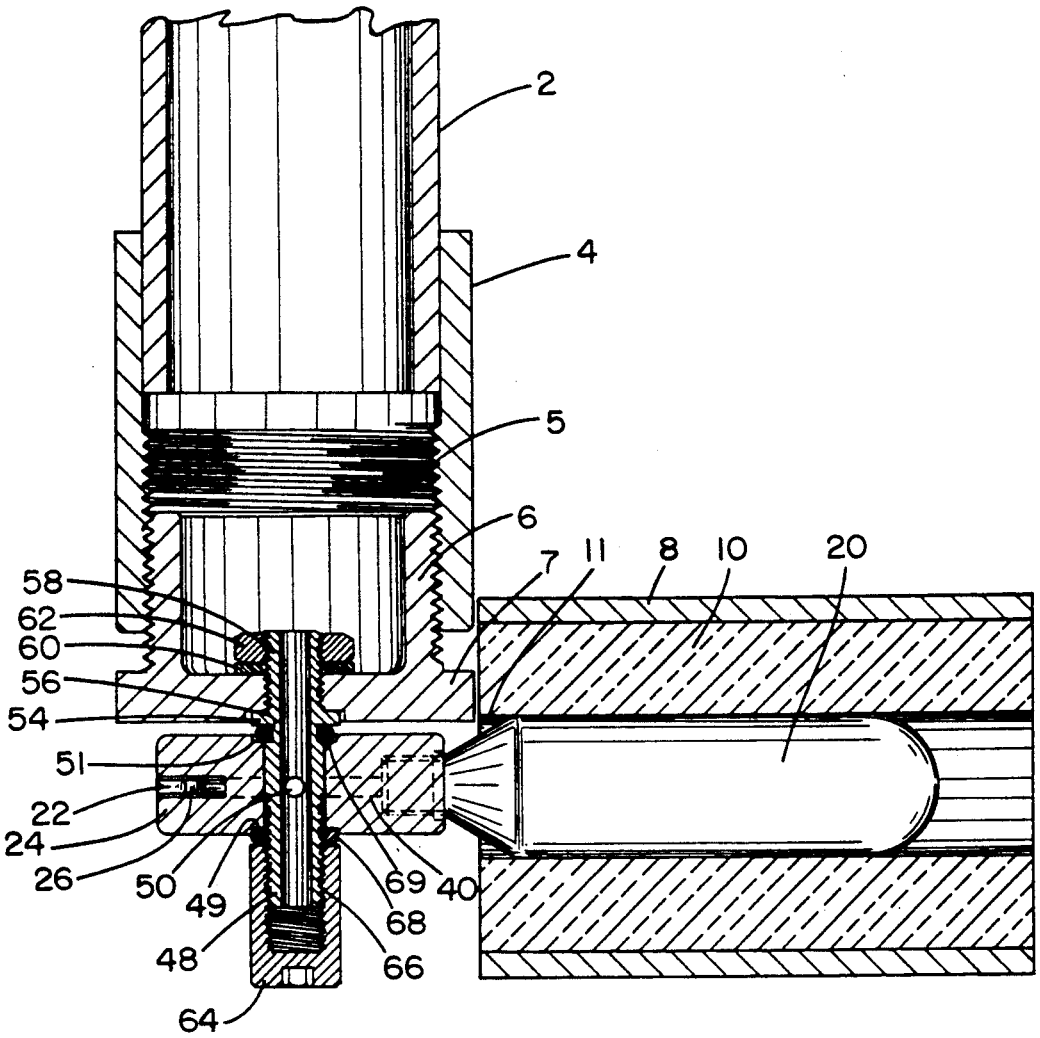
FIG. 2 is a cross-sectional view of the confetti cannon as viewed from the top.
Figure 3:
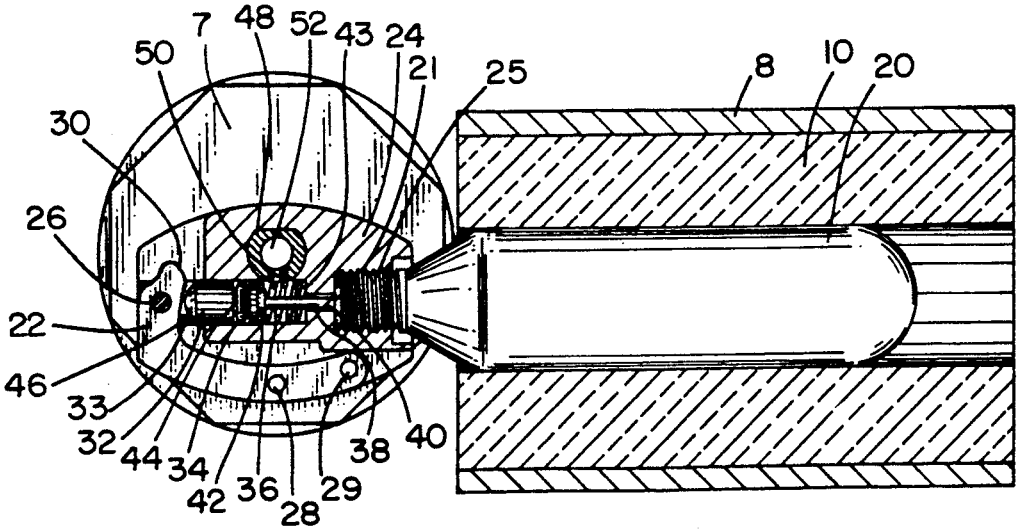
FIG. 3 is a cross-sectional view of the confetti cannon as viewed from the end.

More specifically, the internal workings of the valve assembly are shown in FIGS. 2 and 3. A disposable $CO_2$ cartridge or cylinder 20 is screwed into threads 25 of valve housing 24 until it seats against valve shoulder 21. Plunger pin 38 is permanently fixed in plunger 32 and both can move along the axis of bores 40 and 33 respectively. Helical compression spring 36 is located in bore 40 and is held captive on one end by shoulder 43 of housing 24 and on the other end by shoulder 42 on plunger 32. The spring-biased plunger 32 maintains the sharp, tapered end of plunger pin 38 away from cylinder 20. Lever 22 pivots on pin 26 and can be activated by a cord or other linkage attached to either holes 28 or 29. When lever 22 is activated, cam surface 30 contact striking surface 46 of plunger 32, overcoming the force exerted by spring 36 and moves the plunger and plunger pin toward the cylinder.

The valve 14 is a standard, commercially available device such as Roberts® 840 AM series, and is manually actuated by pulling pull-tab 16 attached to lanyard 18 (see FIG. 1). The lanyard is fastened by crimp clamp 19. These valves are commonly used to inflate life jackets, and have a puncturing mechanism designed to release the contents of a $CO_2$ cartridge substantially instantaneously. By "substantially instantaneously" is meant the total release of the contents of a 12-gram $CO_2$ cartridge in less than about 2 seconds, preferably less than 1½ seconds, and still more preferably less than one second. A slower release will not provide the explosive projectile effect required of the cannon.

The sharp end of plunger pin 38 punctures cylinder 20 and releases the $CO_2$ gas into bore 40. Since plunger pin 38 is hollow and slotted along its length, the gas from cylinder 20 presses into bore 33, through valve hole 50, and finally out valve passageway 52, contacting the compacted confetti inside barrel 2 and exploding it out of the end of the barrel (see FIG. 2 and FIG. 3). O-ring 34, shown in FIG. 3, is located in groove 44 of plunger 32 and prevents gases from escaping around plunger 32 and out of the end of bore 33. Valve 48, shown in FIG. 2, directs the gas flow from the housing 24 into barrel 2 and is also used to attach the housing 24 to PVC nut 6. As shown in FIG. 2, housing 24 slips over valve 48 and is secured by brass cap 64 screwed onto threaded nipple 66 of connecting valve 48. The inner seal is accomplished by O-ring 69 located in valve groove 56 sealing on the inside flange 54 and on the outside against seat 51. The outer seal is accomplished by O-ring 68 sealing on the inside against seat 49 and on the outside against cap 64. Nut 6 having flange 7 is slipped over valve 48 until it abuts flange 54. Washer 60 is installed and nut 62 is screwed onto threads 58 until tight. Coupling 4 is joined to nut 6 by threads 5 and coupling 4 is joined is joined to barrel 2 by a glued slip-fit joint. The nut, coupling and barrel are standard 1½" PVC but can be constructed from other materials as required.

The length and diameter of the barrel are important as they critically affect the confetti "flow pattern". The length of the cannon barrel and the diameter of the barrel may be varied depending on (i) the size of the "payload" to be delivered, (ii) the height to which the payload is desired to travel before showering, and (iii) the overall effect desired. For example, if it is desired to sheet a sizable shower about 40' in the air, a suitable unit may be a 36"–48" cannon which an internal diameter of 1". If a larger shower is desired at a somewhat lower height, a 36" cannon with a 2" diameter can be used. Small versions (e.g., 8" long × ¾" I.D.) have been used, for example, in close = up magic shows where the unit is concealed in a magician's sleeve and confetti appears to be shooting out from his fingertips. Thus, successful units have been developed having sizes of from 8" × ¾" to 3" × 60". In sum, with respect to barrel length, lengths generally range from about 8" to about 60", and preferably are at least about 16". Usually, a length in excess of 48" is not necessary, and most commercial lengths are about 36".

The length/diameter ratio of the barrel is also important. It has been found that in order to enable the plug-type discharge necessary to achieve the desired effect of the cannon of the invention, the barrel has a length-/diameter ratio of at least about 14 and preferably at least about 20. Length/diameter ratios exceeding about 60 are not desirable since a desired shower effect is not obtained; at these higher length/diameter ratios the contents tend to travel more as a plug. The term "length/diameter ratio" assumes that the barrel has a circular cross-section; if the cross-section is other than circular, the length/diameter ratio can be replaced by the length/cross-sectional area ratio, using a circular cross-section for conversion of the length/diameter ratio. The term "diameter" refers to inside diameter.

Figure 4:
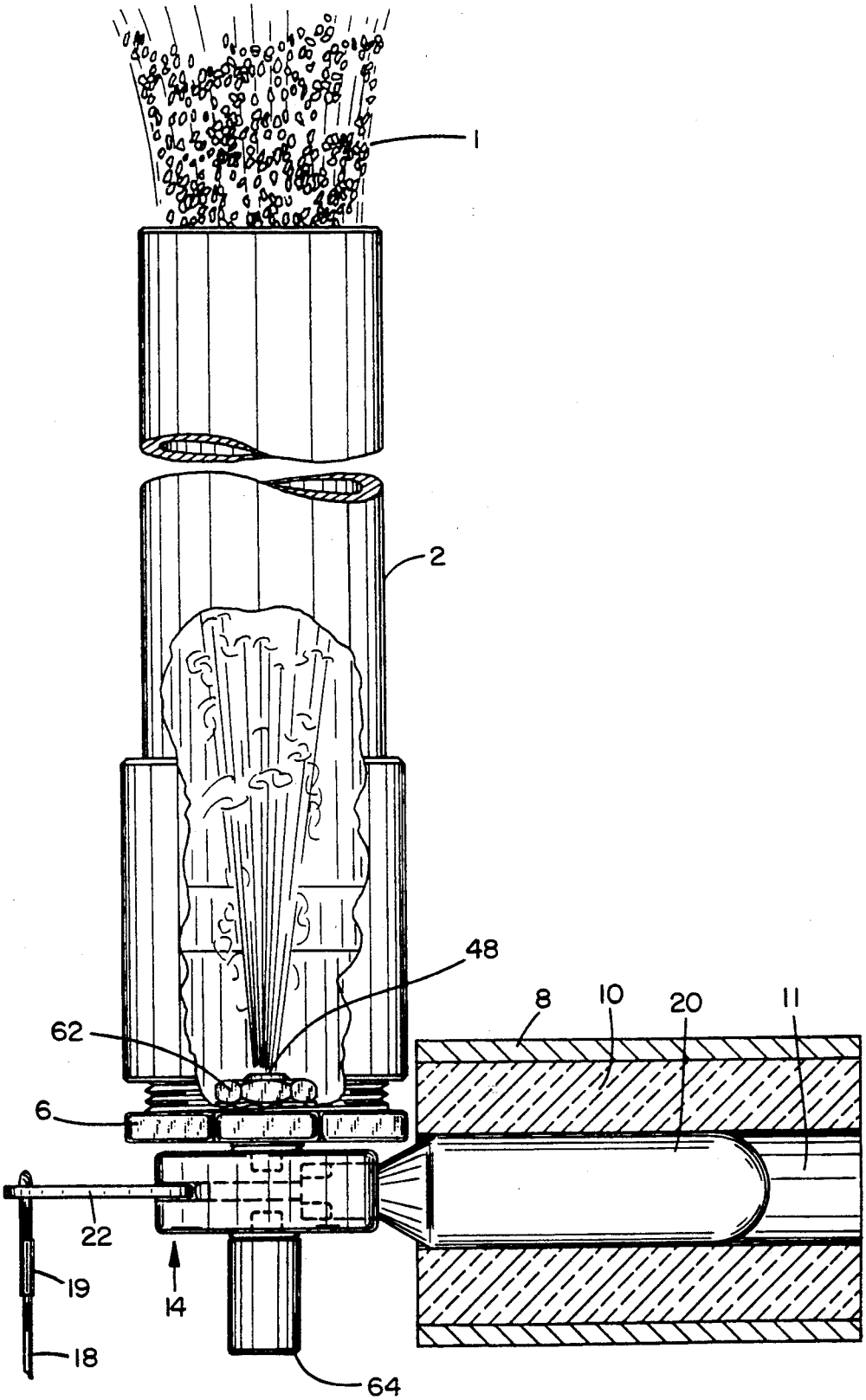
FIG. 4 is a top view of the confetti cannon, with a cutaway of the barrel showing the confetti being discharged.

As seen in FIGS. 1 and 4, the $CO_2$ cartridge 20 is mounted radially at the base of the cannon, and threadedly engages valve 14. The cartridge is maintained within an insulated grip 8 having an annular ring of foam insulation material 10. The insulation has an axial bore 11 into which the cartridge fits slideably and is maintained by friction. FIG. 4 also shows the cannon in discharge mode. The lever arm 22 is shown in actuated position, with the $CO_2$ contents of the cartridge being discharge into the base of the barrel 2. Confetti ejects from the top of the cannon, generally in relatively plug-type flow, exploding to heights of up to 40 feet.

$CO_2$ cartridges are readily available, and are manufactured by Nippon of Japan and Germany or Crossman. In order to provide adequate force for the explosion of the cannon, a cartridge having a net weight of at least 8 grams, and preferably at least 16 grams, is necessary; cartridges of over 24 grams are unnecessary although they can be used.

The materials of construction of the cannon as shown in FIGS. 1–4 are conventional. Housing 24 is PVC plastic; plunger pin 38 is stainless steel; spring 36, lever 22 and pivot pin 26 are steel; plunger 32 is aluminum and the valve 48, cap 64, and nut 62 are brass. O-rings 34, 68 and 69 are rubber and 68 and 69 can be flat if desired.

Operation of the cannon can be seen by referring to FIG. 4 where 1½ to 2 lbs. of confetti 1 is packed and tamped into barrel 2 compacting its volume. The term "packed into the barrel means that the volume is compressed by at least ⅓ and preferably at least about 40% from being loosely poured into the barrel. Shredded paper confetti and confetti streamers are generally packed into the cannon in the same manner; confetti streamers are dumped into the barrel randomly (i.e., without orientation of the coil axes) and are tamped into the barrel to form a "plug". Next, $CO_2$ cartridge 20 is screwed into release valve 14 and insulation sleeve 8 containing insulation material 10 is slipped over the $CO_2$ cartridge (this sleeve is necessary to protect the hands and body from freezing when the $CO_2$ gas is discharged from cylinder 20). The cannon is activated by pulling cord 18 which is attached to lever arm 22 thereby releasing the contents of cylinder 20 through valve 48. The $CO_2$ gas instantly and suddenly explodes the confetti spectacularly into the air some 30'–40' or more in a flower or cone-shaped pattern.

Figure 5:
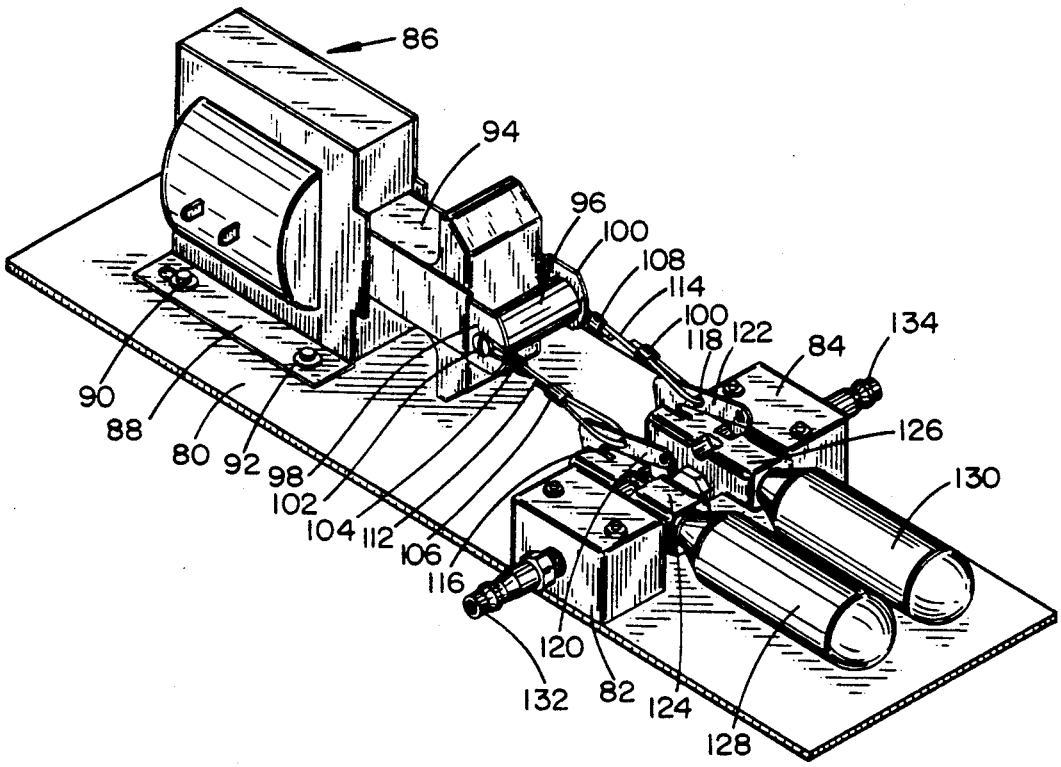
FIG. 5 is a perspective view of a dual automatic confetti cannon system triggered by a solenoid.

An alternate embodiment of the release mechanism of the invention is shown in FIG. 5. This mechanism is used for automatic or remote actuation of one or two cannons electrically during a show or other spectacular event. While a dual discharge unit is illustrated, obviously a singe automatic unit or one which can discharge multiple units, of any desired number can be used. A solenoid actuator 86 is mounted on a base 80 by screws 90 and 92 extending through a flange 88 at a lower portion of the solenoid. A pair of valve housings 82 and 84 are mounted at a forward portion of the base. A pair of quick coupling devices 132 and 134 extend laterally outwardly from the mounting blocks and are connected to cannons of the invention by means of short air hoses (not shown). $CO_2$ cartridges 128 and 130 are mounted in valve housings 124 and 126 which are attached to the valve mounting blocks 82 and 84. The valves are conventional Roberts® valves as previously identified.

The valve actuating mechanism consists of a slideable arm 94 which is actuated by the solenoid 86. The arm has a pair of spaced parallel flanges 98 and 100 separated by a spacer 96. A pair of wire linkages 112 and 114 extend between the flanges 98 and 100 and the lever arms 120 and 122 which actuate the valves. The wires 112 and 114 extend through bores 116 and 118, respectively, in lever arms 120 and 122, and are fastened by means of clamps 106 and 110. At the other ends, the connecting wires 112 and 114 loop around a screw 102 which extends through the flanges 98 and 100, and are fastened by means of clamps 104 and 108. Upon actuation of the solenoid, either by means of a manual electric switch or a clock, two cannons of the invention may be set off simultaneously on stage.

An important feature of the invention is that the chamber and passageways extending between the $CO_2$ cartridge and the interior of the barrel of the cannon are substantially air tight and sealed. The cannon should be maintained substantially sealed to any gas leaks to preclude diminishing the explosive force of the cartridge upon release. Should pressurized gas leak out of the valve upon discharge, the projectile force will be decreased, and the desired effect will not be obtained.

The invention has been described with respect to several specific embodiments thereof, but persons skilled in the art will recognize that a number of additions and modifications to the invention as described may be made without departing from its spirit and scope. Accordingly, the invention should not be considered limited by the foregoing description of embodiments thereof, but rather should be limited only by the following claims.

I claim:

1. A confetti propulsion device for exploding a plug of confetti packed into the device comprises a barrel having a length of at least 8" and a length/inside diameter ratio of from at least 14 to about 60, propulsion means comprising a sealed $CO_2$ cartridge mounted at a lower end of the barrel, valve means operatively connected to the propulsion means for releasing the contents of the $CO_2$ cartridge substantially instantaneously, and trigger means for actuating the valve means.

2. The propulsion device of claim 1 wherein the barrel has a length of at least about 16".

3. The propulsion device of claim 1 wherein the barrel has a length of at least about 16" and a length inside diameter ratio of at least about 20.

4. The propulsion device of claim 1 wherein the $CO_2$ cartridge is mounted perpendicularly to the longitudinal axis of the barrel such that the cartridge discharges into a lower portion of the barrel.

5. The propulsion device of claim 1 also comprising grip means perpendicularly mounted at a lower portion of the barrel, and wherein the $CO_2$ cartridge is mounted interiorly of the grip means.

6. The propulsion device of claim 1 also comprising grip means perpendicularly mounted at a lower portion of the barrel perpendicular thereto, said grip means having a circular cross-section and having the $CO_2$ cartridge mounted therein, and also comprising insulation means mounted between the $CO_2$ cartridge and the grip means.

7. The propulsion device of claim 1 also comprising confetti packed into the barrel along substantially its entire internal length.

8. The propulsion device of claim 1 wherein the valve means comprises means for puncturing the $CO_2$ cartridge such that the entire contents of the $CO_2$ cartridge are discharged within about 2 seconds.

9. The propulsion device of claim 1 wherein the valve means comprises puncturing means for piercing the $CO_2$ cartridge, said puncturing means comprising a slotted hollow pin.

10. The propulsion device of claim 1 wherein the $CO_2$ cartridge contains from about 8 to about 20 grams of $CO_2$.

11. A confetti propulsion device for exploding a plug of confetti packed into the device comprises a barrel having a length of at least 8" and a length/inside diameter ratio of from at least 14 to about 60, propulsion means comprising a sealed $CO_2$ cartridge connected to a lower end of the barrel, valve means operatively connected to the propulsion means for releasing the contents of the $CO_2$ cartridge substantially instantaneously, valve actuating means comprising a base, trigger means for actuating the valve means mounted on the base, and electrical switch means mounted on the base operatively connected to the trigger means, and remote switch means for actuating the electrical switch means located remote from the base.

12. The device of claim 11 wherein the electrical switch means is a solenoid.

13. Confetti propulsion apparatus comprising a base, first and second sealed $CO_2$ cartridges mounted on the base, first and second valve means for releasing the contents of the $CO_2$ cartridges, electrical switch means for simultaneously actuating the first and second valve means, first and second barrel packed with confetti, each having a length of at least about 16" and a length-/inside diameter ratio of at least 14, first and second conduit means for conducting $CO_2$ from the cartridges to the barrels, and remote switch means located remote from the base for actuating the electrical switch means.

14. The confetti propulsion apparatus of claim 13 wherein the barrel has a length inside diameter ratio of at least about 20.

15. The confetti propulsion apparatus of claim 13 wherein the electrical switch means is a solenoid.

16. The confetti propulsion apparatus of claim 13 wherein the confetti is packed into the first and second barrels.

* * * * *